United States Patent [19]

Sakurai et al.

[11] 4,443,101

[45] Apr. 17, 1984

[54] RECORDING PAPER SEPARATION FAILURE RELEASE FOR COPYING MACHINE

[75] Inventors: Isao Sakurai, Hamura; Teruo Minejima, Higashi Murayama, both of Japan

[73] Assignee: Konishiroku Photo Industry Co., Ltd., Tokyo, Japan

[21] Appl. No.: 314,207

[22] Filed: Oct. 23, 1981

[30] Foreign Application Priority Data

Oct. 30, 1980 [JP] Japan ..... 55-153335
Nov. 20, 1980 [JP] Japan ..... 55-164267

[51] Int. Cl.[3] ..... G03G 15/00

[52] U.S. Cl. ..... 355/14 SH; 355/3 SH; 271/258; 271/307; 271/DIG. 2

[58] Field of Search ..... 355/14 SH, 3 SH, 3 TR; 271/DIG. 2, 258, 259, 307, 308

[56] References Cited

U.S. PATENT DOCUMENTS 3,650,619 3/1972 Parker ..... 271/258 X
3,791,729 2/1974 Steiner ..... 355/3 SH
4,073,585 2/1978 Kobayashi et al. ..... 355/14 SH
4,244,648 1/1981 Schultes ..... 355/3 SH

*Primary Examiner*—Richard L. Moses
*Attorney, Agent, or Firm*—James E. Nilles

[57] ABSTRACT

A copying machine in which a toner image is transferred from an image retaining member to a recording paper and, after the transfer of said toner image, said recording paper is separated from said image retaining member and ejected to the outside of said machine. When said recording paper is attached to said image retaining member due to a separation failure, a detector of the separation failure produces a detection signal for displacing a recording paper conveying device to open the passage of said recording paper and to separate said recording paper onto said conveying device. Said detector comprises a light-emitting element and a light-receiving element and is disposed in the vicinity of a passage provided specifically for the forcibly separated recording paper, so as to detect only said forcibly separated recording paper.

8 Claims, 7 Drawing Figures

RECORDING PAPER SEPARATION FAILURE RELEASE FOR COPYING MACHINE

BACKGROUND OF THE INVENTION

1. Field of the Invention:

The present invention relates to a copying machine and, more particularly, to a copying machine capable of discharging recording paper to the outside of the machine in the event of a separation failure after the transfer of the image.

2. Description of the Prior Art:

In the copying machine hitherto proposed and used, an electrostatic latent image formed on an image retaining member is developed to form a toner image which in turn is transferred from the image retaining member to a recording paper. The recording paper is then separated from the image retaining member and is discharged to the outside of the machine after fixing the image.

Various methods have been used for separating the recording paper from the image retaining member. For instance, a separation electrode is used to electrostatically neutralize the charge on the recording paper to separate the latter. It has been also adopted to use a movable separation claw which is temporarily brought into contact with the surface of the image retaining member to separate the recording paper. In some cases, the separation electrode and the separation claw are used in combination.

These conventional separation methods, however, could not achieve a perfect separation. Namely, it is often experienced that the recording paper does not come off from the image retaining member after the transfer of the image and runs off the correct passage of paper to cause a problem of separation failure.

In conventional copying machine, when a separation failure has taken place, the failure is detected by a sensor which produces a signal to temporarily stop the operation of the machine. The operation is started again after the removal of the failure paper. In an ordinary machine, the failure paper is removed manually by a hand inserted into the machine. Unfortunately, in most cases, there is not sufficient room for insertion of the hand around the failure paper. Therefore, usually, the copying machine incorporates a paper conveying means (referred to as guiding device, hereinafter) adapted to form the passage of the recording paper and capable of being moved to make the passage accessible, as a failure release device.

Even with such a guiding device, however, the removal of the recording paper closely sticking to the drum surface has to be made by hand, often resulting in inconveniences such as damaging of the drum surface, scattering of toner particles and so forth.

In order to overcome this problem, the present inventors have proposed, as in the specification of the Japanese Patent Application No. 124,107/1980, a separation failure releasing device having a separation means adapted to separate failure paper from an image retaining member in response to the opening operation of a guiding device movable to open the passage of the recording paper. This proposal, however, is not satisfactory in that it still demands the manual ejection of the separated paper to thereby impose problems such as waste of time and contamination of hand and cloth with toner particles.

The present inventors have proposed also a machine, as shown in the specification of the Japanese Patent Application No. 130,227/1980, capable of eliminating the manual work for ejecting the separated failure paper and without causing damaging of the image retaining member and other parts for forming the image to improve the efficiency of the work. More specifically, this copying machine has a first separation means adapted to separate the recording paper from the image retaining member after the transfer of a toner image from the latter and to eject the separated paper to the outside, and a second separation means disposed at the rear side of the separating position and capable of separating the recording paper without fail so that, in the event of a separation failure by the first separation means, the operation of the paper conveying means and the image retaining member is not stopped but continued to make the second separation means separate the paper which could not be separated by the first separation means and discharge the separated paper to the outside.

SUMMARY OF THE INVENTION

Accordingly, an object of the invention is to provide a copying machine having a separation failure releasing device capable of separating failure paper without being accompanied by scattering of toner particles and damaging of the drum surface.

Another object of the invention is to provide a copying machine having a separation failure releasing device capable of automatically ejecting the separation failure without necessitating any manual work and, hence, without causing any contamination of hand or cloths.

To these ends, according to the invention, there is provided a copying machine of the type in which, after the transfer of a toner image from an image retaining member to a recording paper, the recording paper is separated from the image retaining member and is then discharged to the outside, wherein the improvement comprises: detection means for detecting a separation failure of the recording paper, a guiding device movable to open the passage of the recording paper, and separation means for separating the recording paper attaching to the image retaining member due to separation failure from the latter, the detection means being adapted to produce, upon detect of a failure, a detection signal for moving the guiding device to open the passage and for actuating the separation means to separate the recording paper onto the guiding device, and for resetting the guiding device to the operative position to release the separation failure.

In this machine of the invention, in the event that the failure recording paper is conveyed while attaching to the peripheral surface of the drum as a result of a failure, the separation failure detection means detects this paper without delay to initiate the separation failure releasing operation.

Although not exclusively, an optical density sensor capable of sensing the different of density between the image retaining member and the recording paper can suitably be used as the failure detection means. Upon detect of the separation failure, the separation failure detecting means produces a signal which activates the separation failure releasing device to effect the release of failure.

Various types of separation failure releasing device can be used. For instance, the device can make use of a displacement of the guiding device such that the guiding device having a paper convey means as a whole is slidingly lowered or moved translationally, or is pivotally rotated downwardly around a pivot or hinge axis provided at one end thereof. In such cases, the guiding device may incorporate paper feeding roller movable together with the guiding device so that the rollers pinch therebetween the feed-in side end of the failure paper and pull the paper downwardly as the guiding device as a whole is lowered to separate the failure paper from the image retaining member. It is also possible to provide a guide plate for guiding the recording paper at the feed-in side of the guiding device such that the guide plate hits or presses the failure paper as the guiding device is displaced. Alternatively, an air jet means may be used for effecting the separation by the action of an air jet. These separating means may be used solely or in combination to separate the recording paper and move the latter onto the guiding device.

After the separation, the guiding device carrying the separated paper is moved upward to resume the normal paper conveying position by actuating driving means such as an eccentric cam or a release lever by the force of a reversible motor or the like power source. Then, the reproducing operation is started again so that the failure paper is discharged through the paper convey passage.

Although the detection means produces a signal for activating the separation means upon detect of a failure, in some cases, the separation cannot be completed in one cycle of operation of the separation means, due to various factors such as size of the paper and other external conditions. In view of this fact, the machine can have such a construction as adapted to make the detection means operate repeatedly to check the state of failure and to activate the separation means repeatedly to ensure the perfect separation.

Thus, according to the invention, various troublesome manual works such as opening of the door, manual pick up of the failure paper and so forth are eliminated. Also, accidental starting of the reproducing operation with the failure paper left in the machine is completely avoided. In consequence, according to the invention, it is possible to obviate troubles of damaging of parts due to failure of the recording paper, as well as contamination.

According to another aspect of the invention, there is provided a copying machine in which detection means is provided to surely detect only the recording separation-failed paper separated and conveyed by second separation means but not to detect the paper safely separated by first separation means and conveyed along the correct passage, and the signal produced by the detection means is utilized as required to forcibly separate the recording paper which could not be separated correctly after the transfer of the image, wherein separated paper detection means is disposed along the passage for the forcibly separated paper so as to detect only the forcibly separated paper.

Other objects and advantageous features of the invention will become clear from the following description of the preferred embodiments taken in conjunction with the accompanying drawings.

DESCRIPTION OF THE PREFERRED EMBODIMENTS

Figure 1A:
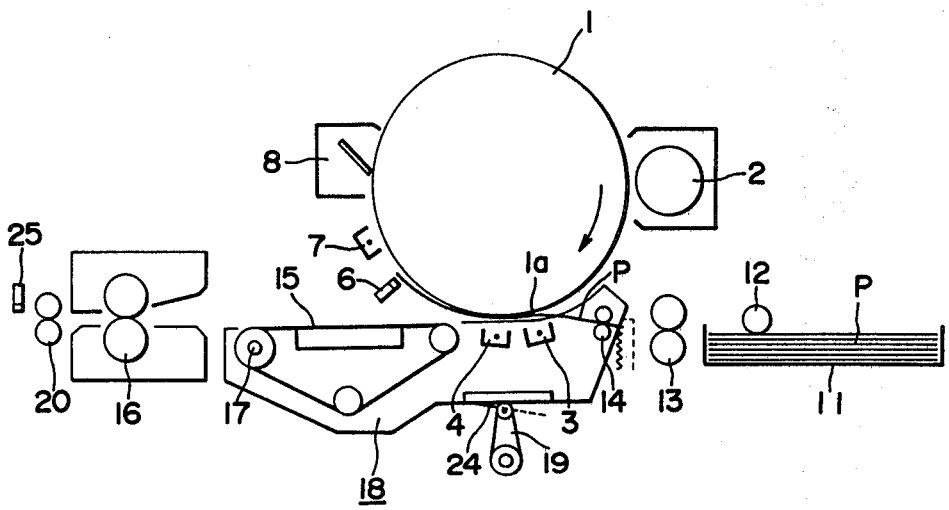
FIG. 1*a* is an illustration of an embodiment of the invention.
Figure 1B:
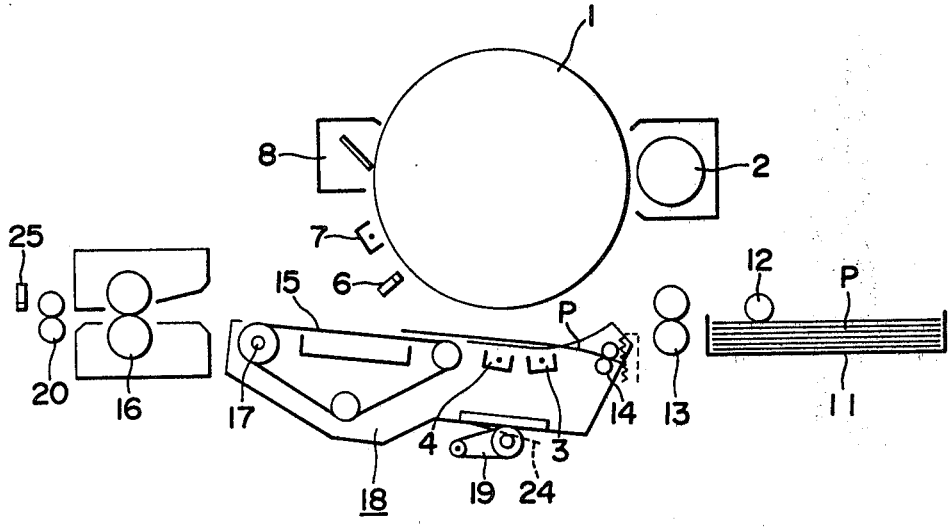
FIG. 1*b* shows the operation of the embodiment shown in FIG. 1*a;*

Referring to FIGS. 1*a* and 1*b*, the following constituents are arranged around a photosensitive drum 1 provided on its outer periphery with an image retaining member made of a material such as a dielectric, selenium, zinc oxide or the like; a development section 2, a transfer electrode 3, a separation electrode 4, a charge eliminating electrode 7, a failure detection device 6 which is a combination of a light-emitting element and a detection section for receiving the light reflected from the photosensitive member, a cleaning device 8 and so forth.

Recording papers P are taken out one by one from a magazine 11 by means of a paper take-out roller 12. A reference numeral 13 denotes paper registration roller, while 14 denotes paper feeding roller. A conveyor section 15 is constituting a rotating belt having perforations of a suitable pitch, and is adapted to absorb and convey the recording paper by air suction. A reference numeral 16 denotes a fixing device.

A rotary shaft 17 constitutes an axis of rotation of a guiding device 18 which includes the paper feeding roller 14, transfer electrode 3, separation electrode 4 and the conveyor section 15.

The photosensitive drum 1 having passed the development section 2 rotates clockwise as illustrated and reach the transfer section 1*a* while retaining the toner image on its peripheral surface.

On the other hand, the transfer paper P is conveyed by the paper registration roller 13 in synchronization with the rotation of the photosensitive drum 1 and reaches the transfer section 1*a* by means of the paper feeding roller 14 where the image is transferred to the paper P. The paper P after the transfer of the image is discharged through the conveyor section 15.

Referring to FIG. 1*a*, in the event of a separation failure, the recording paper P attached to the peripheral surface of the photosensitive drum 1 and arrives at the position of the failure detection device 6 as it attaches to the peripheral surface of the photosensitive drum 1. The failure detection device 6 is adapted to detect the failure from the difference between the reflection from the outer peripheral surface of the drum 1 and the reflection from the reverse side of the recording paper, and produces a signal for stopping the reproducing machine. This signal also activates a reversible motor to rotate a release lever 19, so that the guiding device 18 is rotated downwardly around the axis of the rotary shaft 17 to take the position shown in FIG. 1*b*. A leaf spring 24 is provided for buffering the impact caused by the rotation of the release lever 19 and for serving as a stopper for resetting the release lever to the normal position. The paper feeding roller 14 and the failure detection device 6 are positioned as close as possible to the transfer position 1*a*, the leading end of the recording paper P is located at the position of the failure detection device 6 when the machine is stopped due to failure, while the rear end is clamped between paper feeding roller 14. Therefore, as the guiding device 18 is moved downward as a result of rotation of the release lever 19, the paper feeding roller 14 is temporarily moved downwardly with the feeding roller 14 clamping the failure paper, so that the latter is pulled and smoothly separated from the peripheral surface of the photosensitive drum 1. It is, therefore, possible to separate the failure paper onto the conveyor section 15 without any damaging of the peripheral surface of the photosensitive drum 1 or scattering of the toner particles. Thereafter, as the guiding device 18 reaches the lowermost position to take the state shown in FIG. 1*b*, the reversible motor is reversed to rotate the release lever 19 thereby to rotate the guiding device 18 as a whole upwardly. Simultaneously, the conveyor section 15 is driven to discharge the recording paper P. The reproducing operation is started again after the guiding device 18 has been moved to the normal position shown in FIG. 1*a*.

Thus, the failured paper can be automatically ejected without taking the trouble of manual work by the operator. Also, troubles such as involvement of failure paper in the inside of the machine, which often causes damaging or contamination of internal parts, due to erroneous start of the machine while failure paper is still remaining in the machine, can be completely avoided.

Figure 2:
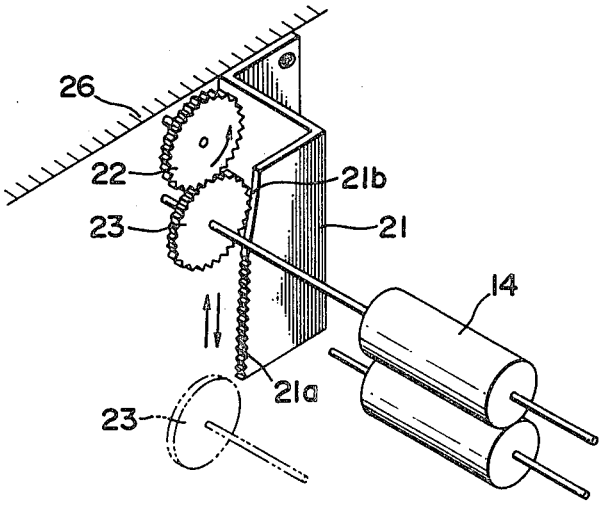
FIG. 2 is an illustration of the improvement of embodiment shown in FIG. 1*a;*

FIG. 2 shows an improvement in the copying machine shown in FIG. 1*a*. The improvement resides in that a guide rack 21 is disposed at the side adjacent to the main body 26 of the copying machine. The guide rack 21 is provided with a rack 21*a* and an upper relief portion 21*b*. During the normal operation, the driving power is transmitted to the paper feeding roller 14 through a paper feeding gear 23 meshing with a drive gear 22 which rotates in the counter-clockwise direction, so that the recording paper P is conveyed by the paper feeding roller 14 toward the fixing section 16. When the release lever 19 is rotated as a result of detection of the separation failure, the guiding deive 18 is rotated around the axis of the rotary shaft 17 and lowered as a unit with the paper feeding roller 14. In consequence, the driving connection between the paper feeding gear 23 on the shaft of the paper feeding roller 14 and the drive gear 22 is dismissed and the paper feeding gear 23 is brought into engagement with the rack 21*a* on the guide rack 21. In consequence, the paper feeding roller 14 are rotated, as the guiding device 18 is lowered, in the direction opposite to the normal direction, i.e. to pull out the recording paper P in the direction away from the fixing section 16. In this process, the transfer paper P is smoothly separated from the peripheral surface of the photosensitive drum 1 and is brought onto the guiding device 18. Then, the reversible motor is reversed to rotate the release lever 19 to make the guiding device 19 move upward together with the paper feeding roller 14 gripping the recording paper P. In consequence, the paper feeding gear 23 is rotated in the direction reverse to the direction during lowering of the guiding device 18 due to specific meshing relation between the guide rack 21*a* and the paper feeding gear 23, so that the paper feeding roller 14 imparts a force to the recording paper P to make the latter move toward the fixing section 16. The conveyor section 15 is driven simultaneously with the rotation of the release lever 19. As a result, the recording paper is smoothly moved toward the fixing section 16 and is then discharged. A same result can be achieved by substituting friction surfaces for the drive gear 22, paper feeding gear 23 and the rack 21*a*.

Thus, by using the arrangement shown in FIG. 2, it is possible to further ensure a perfect separation of the recording paper P during downward movement of the guiding device 18 and to assure the smooth discharge of the recording paper after the resetting of the guiding device 18 to the normal position, to further enhance the advantage of the invention.

The copying machine of the described embodiment is inconvenient in that, since the failured recording paper is discharged through the same passage as the recording papers which have been separated correctly, it is not possible to confirm whether the desired reproduction has been achieved. To avoid this inconvenience, it is possible to ensure the desired number of sheets of copy or reproduction by using, in combination with a detector 25 disposed, besides the separation failure detection device 6, in the vicinity of a paper discharging section 20 for detecting and counting the number of recording papers discharged, such a sequence circuit as adapted to suspend the counting upon receipt of a signal from the detection device 6 when the separation failure has taken place.

As has been described, according to the invention, it is possible to eliminate various manual works which have been required in the conventional copying machine in the event of a separation failure, to obviate not only the waste of time but also troubles such as contamination during manual taking out of recording paper before the fixing. In addition, it is possible to avoid damaging of photosensitive member, separation claw, separation electrode and other parts which may occur separation of the failure paper.

Figure 3:
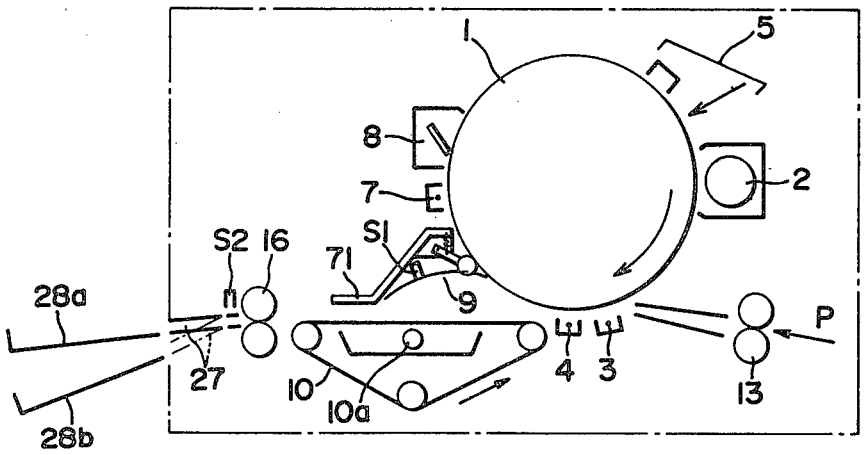
FIG. 3 is an illustration of another embodiment of the invention having a separation device.

FIG. 3 shows another embodiment of the invention in which the same reference numerals are used to denote the same parts or members as those used in the preceding embodiment. This embodiment incorporates an electrostatic latent image recording section 5, separation device 9, a conveyor belt 10, suction 10*a*, conveyor switching section 27 and paper discharge trays 28*a*, 28*b*.

The copying machine of this embodiment operates in a manner explained hereinbelow. As the photosensitive drum 1 rotates past the electrostatic latent image recording section 5, and electrostatic latent image is formed on the surface of the drum 1. Then, the electrostatic image is developed into toner image as the drum 1 rotates past the toner developing device 2.

Meanwhile, the recording paper P is fed by paper resistration roller 13 in synchronization with the operation of the photosensitive drum 1 and contacts the photosensitive drum 1 in the transfer section 3 so that the toner image is transferred from the peripheral surface of the photosensitive drum 1 to the recording paper. Subsequently, the transfer paper P is separated from the peripheral surface of the photosensitive drum 1 by the action of a separation electrode 4, and is absorbed by the suction 10*a* and brought into close contact with the conveyor belt 10 so as to be conveyed to the left as viewed in the drawings as the transfer belt 10 rotates. The recording paper P is then discharged to the paper discharge tray 28*a* for correctly separated papers, through the fixing device 16.

The separation electrode 4 is an advantageous separation means in that it can separate the recording paper from the photosensitive drum 1 without contacting the paper, but sometimes fails to separate the recording paper. The operation of the machine in the event of a separation failure will be explained hereinunder.

Figure 4:
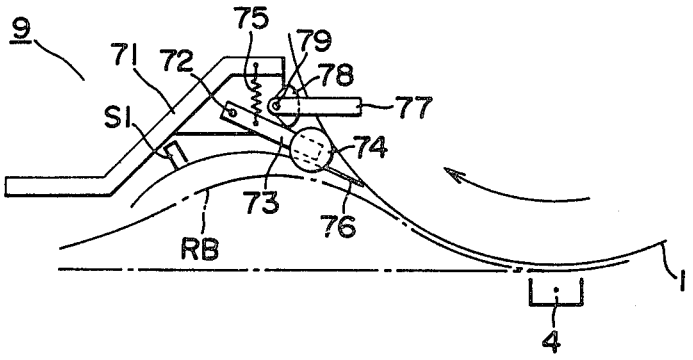
FIG. 4 is a side elevational view of the separation device.

Referring to FIG. 4 showing the detail of the separation device 9, a guide plate 71 fixed integrally with the machine body carries a support shaft 72 constituting an axis of pivotal movement of a lever 73. The lever 73 carries a roller 74 having an axis of rotation on the lever 73. A spring 75 stretched between the lever 73 and the guide plate 71 acts to press the roller 74 against the photosensitive drum 1 so as to be driven by the latter.

A separation member 76 fixed to the lever 73 is made from a thin sheet of a metallic material or a miler film. A separation device shifting lever 77 is provided with a cam surface 78 and is rotatably supported buy the support shaft 79. This lever is adapted to keep the separation device 9 away from the image retaining member, in order to prevent the latter from being damaged by the end of the lever 73 during attaching and detaching of the separation device 9 to and from the body of the machine.

According to this arrangement, it is possible to maintain, using a specific jig, the clearance between the peripheral surface of the photosensitive drum and the end of the separation member 76 on the order of 0.01 to 0.06 mm. By positioning the end of the separation member 76 in the close proximity to but out of contact with the phtosensitive drum 1, the failure paper which could not be separated by the separation electrode is separated without fail by the separation member 76, because the paper usual has a thickness in excess of 0.074 mm. The paper separated by the separation member 76 is then conveyed along the path indicated by RB.

This paper carries an image which is disordered as a result of contact with the toner image surface in the separation device 9 and, hence, cannot be used as the copy of document.

In this embodiment, a sensor $S_1$ for sensing only the separated failure paper is disposed along or in the vicinity of the patch RB of the separated failure paper. The sensor $S_1$ is constituted by a light-emitting element such as a light-emitting device and a light-receiving element such as a photo-transistor. The light-emitting element and the light-receiving element may be constructed as a unit or may be formed separately.

The sensor $S_1$ is adapted to sense the passage of the separated failure paper as a part of the light emitted from the light-emitting element is reflected by the separated failure paper and received by the light-receiving element.

If the sensor $S_1$ is disposed in such a manner as shown in FIG. 3, the recording paper which has been forcibly separated by the separation device 9 is oriented such that its surface carrying the image faces the sensor $S_1$.

In general, the surface of the recording paper carries a toner image. In order to detect this toner image, it is necessary to increase the amount of emission of light to obtain a large amount of reflected light, or to use a light-receiving element having a higher sensitivity or a light-receiving element having smaller level of dark current.

On the other hand, the recording paper which has been separated correctly is made to pass through the conveyor section located somewhat remotely from the sensor $S_1$ downwardly so as to reflect only a small portion of the light from the sensor $S_1$. To this end, the characteristics of the light-emitting and light-receiving elements and the distance of the sensor from the paper have to be selected such that the sensor $S_1$ can sense the toner image of the separated failure paper after the forcible separation by the separation device 9 but does not sense the white blank portion of the recording paper which has been correctly separated and moving along the conveyor section. According to the results of an experiment, it is necessary to locate the sensor $S_1$ at least 13 mm apart from the recording paper, in order to sense the toner image (reflectance 2%) of the paper at a distance of between 3.5 to 6 mm while preventing the detection of the white blank recording paper.

In the described embodiment also, the position of the sensor $S_1$ is determined in view of the above-explained results of experiment. In order to further ensure the safe functioning of the sensor $S_1$, a non-luster treatment is effected on the upper surface of the conveyor section so as to reduce the optical noise reflected by the conveyor section and received by the light-receiving element. Therefore, the sensor $S_1$ can sense only the separated failure paper and does not sense the passage of the correctly separated recording papers.

By providing another sensor $S_2$ for confirming the discharge of the paper at the paper discharge section, it is possible to achieve the following functions by using these two sensors.

(1) It is possible to switch the conveyor switching section 27 so that the separated failure paper is discharged to the tray **28*b* specifically provided for the separated failure paper but not to the tray 28*a*** for correctly separated ordinary copies.

(2) In counting the number of sheets of copy, the counting is not made for the separated failure paper.

Figure 5:
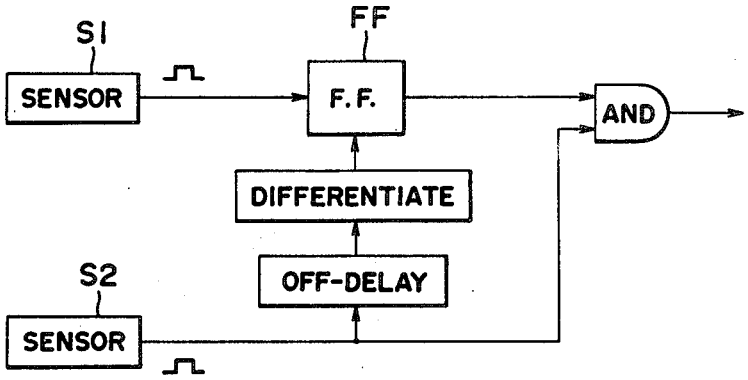
FIG. 5 is a control circuit diagram of the machine of the invention shown in FIGS. 3 and 4.
Figure 6:
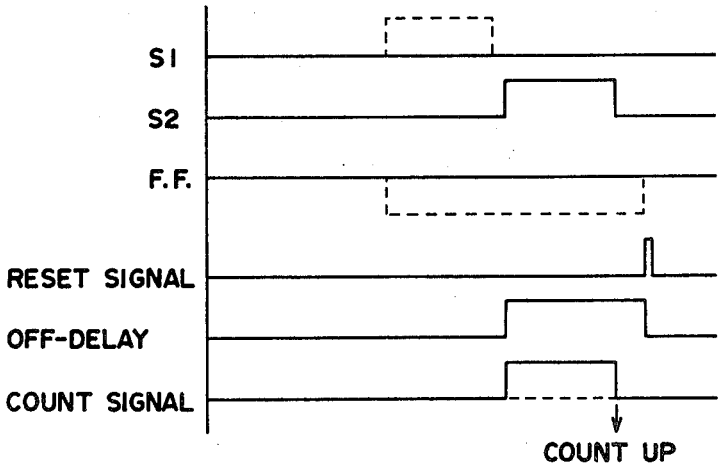
FIG. 6 is a sequence diagram showing the sequence of operation of the circuit shown in FIG. 5.

These functions can be achieved by a circuit shown in FIG. 5 which operates in a sequence as shown in FIG. 6. The broken lines in FIG. 6 show the operation in the event of a separation failure.

Referring to FIG. 5, the sensor $S_1$ for sensing the separated failure paper is connected to the set input terminal of a separation failure detection FF (flip-flop). An AND circuit has one input terminal connected to the output terminal of the separation failure detection FF and the other input terminal connected to the sensor $S_2$ for sensing the discharged recording paper. The output of the AND circuit is used as the count signal of a copy counter (not shown).

The sensor $S_2$ is connected also to the off-delay circuit the output of which is connected to a differentiation circuit. The output from the differentiation circuit is connected to the reset terminal of the separation failure detection FF.

During the ordinary functioning of the machine, the sensor $S_1$ for sensing the separated failure paper does not sense any paper, so that the separation failure detection FF takes the reset state to deliver the signal of "1" level to one of the input terminals of the AND circuit. Then, as the recording paper is detected by the discharged paper sensor $S_2$, the latter delivers a signal of "1" to the other of the input terminals of the AND circuit so that the latter produces an output of "1" level. Then, after the discharge of the recording paper, the sensor $S_2$ delivers a "0" level signal to the AND circuit so that the output from the latter is changed to take the "0" level to cause a copy count on the machine to count "1" sheet.

In the event of a separation failure, the sensor $S_1$ detects the recording paper forcibly separated by the second separation means, so that the separation failure detection FF is set to produce an output of the "0" level which is delivered to one of the input terminals of the AND circuit. Then, as the sensor $S_2$ detects the discharged recording paper, a signal of the "1" level is delivered to the other input terminal of the AND circuit. In this case, however, the AND circuit maintains its output at "0" level, because the first input terminal thereof receives the signal of the "0" level. Therefore, the AND circuit does not deliver the count signal to the copy counter even when it receives the signal from the sensor $S_2$. Thus, the counter counts only the number of the correctly separated recording papers, while the recording paper which has been forcibly separated by the second separation means is not counted.

The off-delay circuit produces an output signal upon receipt of the signal from the sensor $S_2$. This output is maintained for a while even after the extinguishment of the signal from the sensor $S_2$ and is delivered to the differentiation circuit. To this end, the off-delay circuit has a known circuit arrangement including a resistance, capacitor, diode and comparator. The differentiation circuit is adapted to produce, as the reset signal for resetting the separation failure detection FF, at the moment at which the output signal from the off-delay circuit is ceased. To this end, the differentiation circuit has an ordinary circuit arrangement consisting of a resistance and a capacitor. Therefore, the reset signal is delivered at a certain time lag from the detection of the recording paper by the sensor $S_2$. Thus, when the separation failure detection FF is in the reset state, there is no change in the state of output. However, when the same is in the set state, the output therefrom is changed from the "0" level to the "1" level to reset to the ordinary state of operation.

The counting operation for counting the recording papers has been described. The switching operation of the conveyor switching section 27 can be made by making use of a solenoid adapted to operate in accordance with the state of the separation failure detection FF, such that the passage is switched as the separation failure detection FF is set and returned to the ordinary position in accordance with the resetting of the separation failure detection FF. By so doing, it is possible to direct the separated failure paper to the tray 28*b*.

The present inventors have already succeeded in eliminating separation failure and the manual labour for removing the failure paper, by proposing the invention disclosed in the specification of the Japanese Patent Application No. 130,227/1980. In consequence, not only the waste of time but also various problems such as contamination of hand during removal of recording paper carrying unfixed toner image and so forth, while avoiding the damaging of the photosensitive member, separation claw, separation electrode and other parts due to forcible withdrawal of the failure paper.

The present invention further enhances these advantages offered by the preceding embodiment by proposing a copying machine having the above-described detection means. Namely, by a combination of the detection means and the illustrated electric circuit, it is possible to perform exact indication of the number of copy sheets, as well as the ejection of the separated failure paper which is useless. The detection means in the copying machine of the invention offers various other advantages than those described in this specification.

What is claimed is:

1. In a copying machine in which a toner image is transferred from an image retaining member to a recording paper and, after the transfer of said toner image, said recording paper is separated from said image retaining member by the operation of a first separation means and ejected to the outside of said machine, the improvement comprising: a detection means for detecting a separation failure of said recording paper, a recording paper conveying means displaceable to open the passage of said recording paper, and a second separation means for separating, from said image retaining member, said recording paper which is attaching to said image retaining member due to said separation failure, said detection means being adapted to produce a detection signal for displacing said recording paper conveying means to open said passage of said recording paper and to actuate said second separation means so as to separate said recording paper onto said conveying means, said conveying means being adapted to be reset thereafter to the ordinary position thereby to release the separation failure.

2. A copying maching according to claim 1, wherein said second separation means is a paper registration roller.

3. A copying machine according to claim 1, wherein said detection means comprises a light-emitting element and a light-receiving element.

4. A copying machine according to claim 1, wherein a means for displacing said recording paper conveying means is a release lever.

5. A copying machine according to claim 1, wherein said second separation means comprises a paper feeding roller for feeding said recording paper to said passage of the recording paper and a means for rotating said feeding roller in the opposite direction to said feeding direction.

6. In a copying machine in which a toner image is transferred from an image retaining member to a recording paper and, after the transfer of said toner image, said recording paper is separated from said image retaining member by the operation of a first separation means and ejected to the outside of said machine, the improvement comprising: a second separation means for forcibly separating, from said image retaining member, said recording paper which is attaching to said image retaining member due to a separation failure of said recording paper, said second separation means being arranged adjacent to said image retaining member; a recording paper conveying means for conveying said recording paper to the outside of said machine; and a detection means for detecting only said recording paper forcibly separated by said second separation means so as to distinguish said forcibly separated recording paper from the recording paper separated by said first separation means.

7. A copying machine according to claim 6, wherein said second separation means comprises a separation member keeping clearance away from said image retaining member, said clearance having an order thinner than a thickness of said recording paper.

8. A copying machine according to claim 6, wherein said detection means comprises a light-emitting element and a light-receiving element.

* * * * *